US008322750B2

(12) United States Patent
Crow et al.

(10) Patent No.: US 8,322,750 B2
(45) Date of Patent: Dec. 4, 2012

(54) TRAILER INCORPORATING A BEAM STRUCTURE

(75) Inventors: Michael A. Crow, Mountain Home, AR (US); Gary L. Potter, Mountain Home, AR (US)

(73) Assignee: EZ Loader Custom Boat Trailers, Inc., Midway, AR (US)

( * ) Notice: Subject to any disclaimer, the term of this patent is extended or adjusted under 35 U.S.C. 154(b) by 0 days.

(21) Appl. No.: 12/752,346

(22) Filed: Apr. 1, 2010

(65) Prior Publication Data

US 2011/0232227 A1 Sep. 29, 2011

Related U.S. Application Data

(60) Provisional application No. 61/165,929, filed on Apr. 2, 2009.

(51) Int. Cl.
*B62D 21/00* (2006.01)
*B62D 63/06* (2006.01)

(52) U.S. Cl. ..... 280/789; 280/798; 280/800; 296/204; 296/205; 52/843

(58) Field of Classification Search ..... 52/839, 52/843, 846; D25/124, 126, 127; 296/204, 296/205; 280/789, 798–800
See application file for complete search history.

(56) References Cited

U.S. PATENT DOCUMENTS

| | | | | | |
|---|---|---|---|---|---|
| 378,561 | A * | 2/1888 | Waring | 138/157 |
| 824,550 | A * | 6/1906 | Lazerges | 296/204 |
| 875,018 | A * | 12/1907 | Verschave | 296/204 |
| 1,848,895 | A * | 3/1932 | MacPherson | 280/800 |
| 2,951,566 | A * | 9/1960 | Armenti et al. | 52/630 |
| 3,009,548 | A * | 11/1961 | Miller | 52/846 |
| 3,332,197 | A * | 7/1967 | Hinkle | 52/844 |
| 3,363,390 | A * | 1/1968 | Crane et al. | 52/716.8 |
| 3,566,541 | A * | 3/1971 | Coulter | 49/475.1 |
| D237,264 | S * | 10/1975 | Edwards | D25/122 |
| 3,979,133 | A * | 9/1976 | Morris | 280/42 |
| 4,671,530 | A * | 6/1987 | van der Wouden | 280/656 |
| 5,050,363 | A * | 9/1991 | Fornell | 52/656.2 |
| 5,555,695 | A * | 9/1996 | Patsy, Jr. | 52/843 |
| 5,611,945 | A * | 3/1997 | Kuwabara et al. | 219/119 |
| D382,653 | S * | 8/1997 | Colitto | D25/122 |
| 5,775,711 | A * | 7/1998 | Floe | 280/405.1 |
| 5,899,035 | A * | 5/1999 | Waalkes et al. | 52/239 |
| 6,505,449 | B1 * | 1/2003 | Gregori | 52/514 |
| 6,527,487 | B2 * | 3/2003 | Adams | 410/104 |
| D494,801 | S * | 8/2004 | Lee | D6/580 |
| 6,811,212 | B2 * | 11/2004 | Kasuga | 296/205 |
| 6,826,884 | B2 * | 12/2004 | Pabedinskas et al. | 52/839 |
| 7,234,762 | B2 * | 6/2007 | Dyer | 296/185.1 |
| 7,287,780 | B2 * | 10/2007 | Reese et al. | 280/789 |
| 7,665,768 | B2 * | 2/2010 | Duval | 280/789 |
| 7,770,928 | B2 * | 8/2010 | Booher | 280/789 |
| 2003/0061782 | A1 * | 4/2003 | Fisher | 52/730.4 |
| 2010/0132285 | A1 * | 6/2010 | Wood | 52/274 |

* cited by examiner

*Primary Examiner* — Robert Canfield
(74) *Attorney, Agent, or Firm* — L.C. Begin & Associates, PLLC

(57) ABSTRACT

One embodiment of a beam structure may include a first side panel and a second side panel spaced apart from the first side panel. An intermediate panel extends from an intermediate portion of the first side panel to an intermediate portion of the second side panel. Further, the beam structure may include an end panel extending from an end portion of the first side panel to an end portion of the second side panel. The end panel may be spaced apart from the intermediate panel for configuring an enclosed channel bounded by the first and second side panels, the intermediate panel, and the end panel.

9 Claims, 3 Drawing Sheets

TRAILER INCORPORATING A BEAM STRUCTURE

CROSS REFERENCE TO RELATED APPLICATION

This application claims the benefit of U.S. Provisional Application No. 61/165,929 filed on Apr. 2, 2009, the disclosure of which is incorporated by reference.

FIELD OF THE INVENTION

The present disclosure generally relates to beam structures, and more specifically, to a beam structure having an enclosed channel.

BACKGROUND OF THE INVENTION

The use of beam structures for constructing frames for trailers, such as a utility trailer or a boat trailer, is well known. For example, I-beam structures may be used for constructing a frame of a utility trailer.

Typically, routing of electrical cables, brake lines, and wiring harnesses (hereinafter referred to as cables) in such trailers may present a difficult problem. The cables may be exposed to adverse environmental conditions (for example, extremes and cycling of temperature and humidity), causing the cable structure to deteriorate. The damaged cables may present a safety hazard for people driving on roads, and may even cause damage to the trailer. For example, a damaged electrical cable may cause failure of a tail light, causing a safety hazard for drivers, particularly at night. Further, damaged electrical cables may increase the probability of a short-circuit.

SUMMARY OF THE INVENTION

In accordance with embodiments of the present invention, one embodiment of a beam structure may include a first side panel. The beam structure may also include a second side panel spaced apart from the first side panel and extending substantially parallel to the first side panel. The beam structure may also include an intermediate panel extending perpendicularly from the first side panel to an opposed intermediate portion of the second side panel, along a length of the first side panel and the second side panel. Further, the beam structure may include an end panel extending perpendicularly from an end portion of the first side panel to an end portion of the second side panel, along a length of the first side panel and the second side panel. The end panel may be spaced apart from the intermediate panel and extend substantially parallel to the intermediate panel for configuring an enclosed channel bounded by the first and second side panels, the intermediate panel, and the end panel.

BRIEF DESCRIPTION OF THE DRAWINGS

The advantages and features of the present disclosure will become better understood with reference to the following detailed description and claims taken in conjunction with the accompanying drawings, in which:

Like reference numerals refer to like parts throughout the description of the drawings.

DETAILED DESCRIPTION

The exemplary embodiments described herein detail for illustrative purposes are subject to many variations in structure and design. It should be emphasized, however, that the present disclosure is not limited to a particular beam structure, as shown and described. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein is for the purpose of description and should not be regarded as limiting.

The terms "a" and "an" herein do not denote a limitation of quantity, but rather denote the presence of at least one of the referenced item. The terms "first," "second," and the like, herein do not denote any order, quantity, or importance, but rather are used to distinguish one element from another. The use of "including," "comprising," or "having" and variations thereof herein is meant to encompass the items listed thereafter and equivalents thereof as well as additional items. Unless limited otherwise, the terms "attached" and "coupled" and variations thereof are not restricted to physical or mechanical attachments or couplings.

The present disclosure provides a beam structure which may be used for construction purposes. For example, the beam structure may be used for constructing a frame for a trailer.

Figure 1:
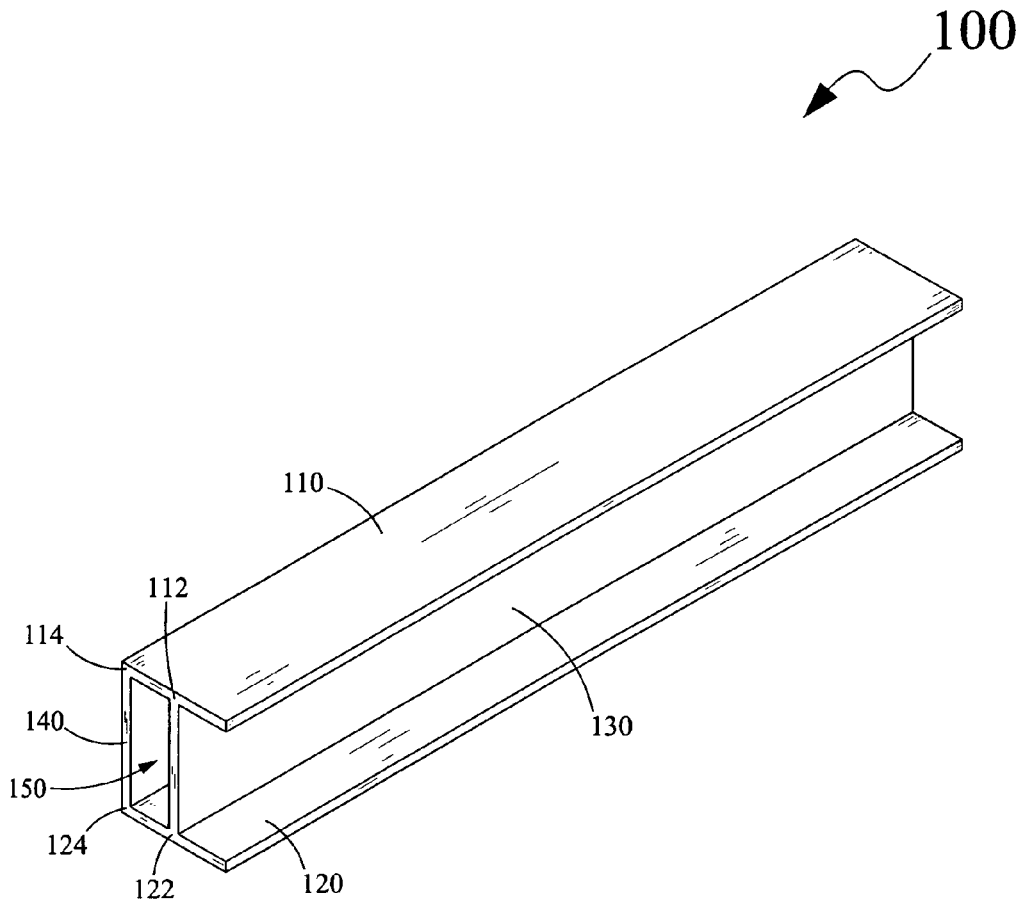
FIG. 1 is a perspective view of one embodiment of a beam structure.

Referring to FIG. 1, one embodiment of a beam structure 100 may include a first side panel 110. In the present embodiment, the first side panel 110 may be configured to have a rectangular shape. For example, the first side panel 110 may be configured to resemble a top panel of a conventional I-beam structure.

The beam structure 100 may also include a second side panel 120 spaced apart from the first side panel 110 and extending along a length of the first panel. In a particular embodiment, the second side panel extends substantially parallel with the first side panel. The second side panel 120 may be configured to have a rectangular shape. In a particular embodiment, the second side panel 120 may be configured to have substantially the same shape and dimensions as the first side panel 110. In a particular embodiment, the second side panel extends along the entire length of the first side panel. For example, the second side panel 120 may be configured to resemble a bottom panel of a conventional I-beam structure.

The beam structure 100 may also include an intermediate panel 130. The intermediate panel 130 may extend perpendicularly from an intermediate portion 112 of the first side panel 110 to an intermediate portion 122 of the second side panel 120. However, the intermediate panel may be positioned and/or shaped to extend from the first and second side panels so as to form any desired angle with the first side panel and/or the second side panel, depending on the requirements of a particular application, and subject to manufacturing tolerances and other factors tending to cause the angles formed between the intermediate panel and the first side panel and between the intermediate panel and the second side panel to deviate from exact values. Further, as shown, the intermediate panel 130 extends along a length of the first side panel 110 and along a length of the second side panel 120. In a particular embodiment, the intermediate panel extends along the entire lengths of the first and second side panels. The intermediate panel 130 may be configured to have a rectangular shape. For example, the intermediate panel 130 may be configured to resemble an intermediate panel or web of a conventional I-beam structure. The intermediate panel 130 may act both as a weight supporting member or weight transferring member, capable of transferring weight from the first side panel 110 to the second side panel 120, or vice versa.

Further, the beam structure 100 may include an end panel 140. The end panel 140 may extend from an end portion 114 of the first side panel 110 to an end portion 124 of the second side panel 120 and along a length of the first side panel 110 and the second side panel 120. In a particular embodiment, the end panel 140 extends perpendicularly from an end portion 114 of the first side panel 110 to an end portion 124 of the second side panel 120. However, the end panel may be positioned and/or shaped to extend from the first and second side panels so as to form any desired angle with the first side panel and/or the second side panel, depending on the requirements of a particular application, and subject to manufacturing tolerances and other factors tending to cause the angles formed between the end panel and the first side panel and between the end panel and the second side panel to deviate from exact values. In a particular embodiment, the end panel 140 extends along the entire length of both the first side panel 110 and the second side panel 120. The end panel 140 may be configured to have a rectangular shape having substantially the same dimensions as the intermediate panel 130. The end panel 140 may be spaced apart from the intermediate panel 130 for configuring an enclosed channel 150 bounded by the first and second side panels 110, 120, the intermediate panel 130, and the end panel 140. In a particular embodiment, the end panel extends substantially parallel to the intermediate panel. Further, the end panel 140 may act both as a weight supporting member or weight transferring member, capable of transferring weight from the first side panel 110 to the second side panel 120 or vice versa. Therefore, the end panel 140 may provide additional strength to the beam structure 100.

A beam structure 100 in accordance with an embodiment of the present invention may be made of a material having sufficient rigidity such that the beam structure 100 may be capable of bearing a load without experiencing excessive deflection. Further, the beam structure 100 may be made of a lightweight and non-corrosive material. A suitable example of the lightweight and non-corrosive material may include, but is not limited to, aluminum. It is to be understood that the material of the beam structure 100 should not be considered as a limitation to the present disclosure. Moreover, the beam structure 100 may be manufactured by using a suitable manufacturing method, such as machining, casting, and molding, extrusion, or any other suitable method. It is to be understood that the manufacturing method of the beam structure 100 should not be considered as a limitation to the present disclosure. In one particular embodiment, the beam structure 100 of the present disclosure may be manufactured from aluminum by extrusion.

Figure 2:
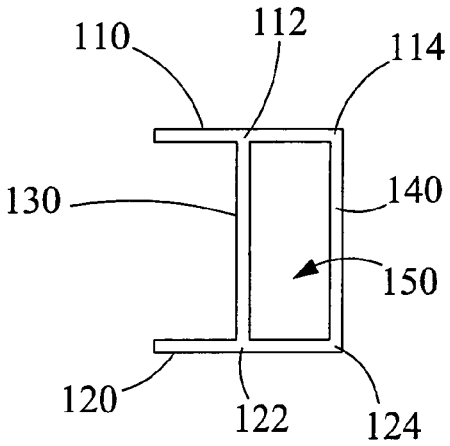
FIG. 2 is a front view of the beam of FIG. 1.
Figure 3:
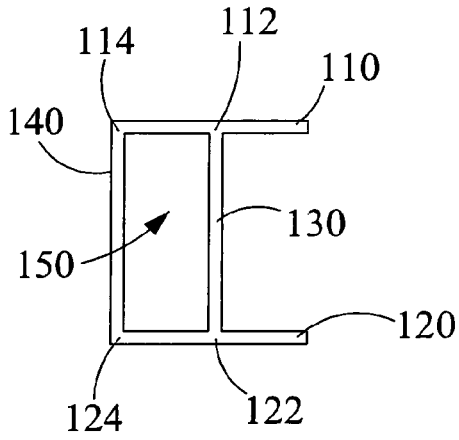
FIG. 3 is a rear view of the beam of FIG. 1.
Figure 4:
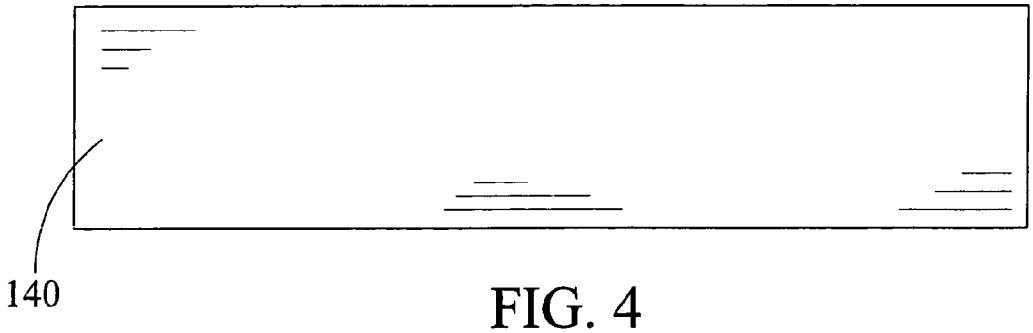
FIG. 4 is a right-hand side view of the beam of FIG. 1.
Figure 5:
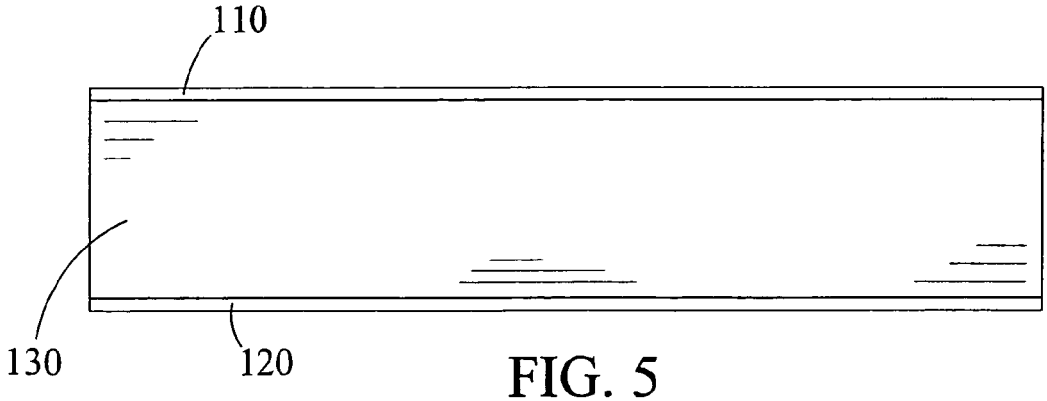
FIG. 5 is a left-hand side view of the beam of FIG. 1.
Figure 6:
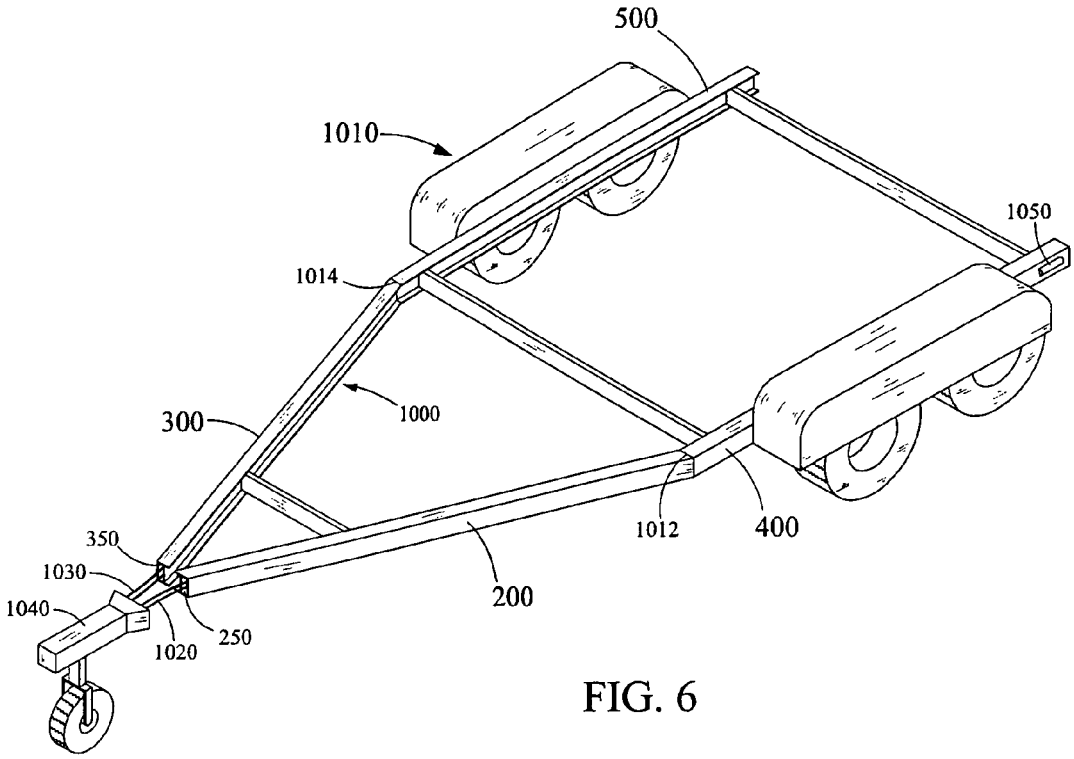
FIG. 6 is an environment in which the beam structure of FIG. 1 may be used for constructing a frame for a trailer.

Referring now to FIG. 2, in use, a plurality of beam structures, such as the beam structure 100, may be utilized for constructing a frame 1000 for a trailer 1010. Specifically, a beam structure, such as the beam structure 100, may be bent or cut into sections and/or otherwise may be coupled with other similar beam structures for constructing the frame 1000. As shown, a plurality of beam structures 200, 300, 400, and 500, similar to the beam structure 100, may be bolted or welded together for constructing the frame 1000. For example, the plurality of beam structures 200, 300, 400, and 500 may be coupled at respective points 1012 and 1014 to form the frame 1000. Moreover, it is to be understood that, the beam structures 200, 400 may be a single beam structure which may be bent at 1012, and the beam structures 300, 500 may be a single beam structure which may be bent at 1014, to form the frame 1000.

Further, the plurality of beam structures 200, 300, 400, and 500 may routing cables, such as electrical cables, brake lines, and wiring harnesses, through enclosed channels thereof. As shown, enclosed channels 250 and 350 of the beam structures 200 and 300 may be adapted to receive a plurality of cables 1020 and 1030 therethrough. It is to be understood that in FIG. 2 the frame 1000 is shown disconnected from a front portion 1040 of the trailer 1010 for the purpose of showing the plurality of cables 1020 and 1030.

The plurality of cables 1020 and 1030 may be further routed through enclosed channels of the beam structures 400 and 500 for reaching desired positions on the frame 1000. For example, a cable 1020, which may be an electrical cable, may be allowed to be routed through the enclosed channels of the beam structures 200 and 400 for reaching a tail light 1050, thereby facilitating an electrical coupling between the tail light 1050 and the cable 1020. Similarly, other cables, such as brake lines and wiring harnesses, may be routed through the plurality of beam structures 200, 300, 400, and 500 for reaching the desired positions. Openings may be formed at any desired location along any of the beam portions to permit coupling of cables routed through the channels to an associated light or other device. This enables flexible positioning of the lights and other devices at any desired location along the beam structures.

Accordingly, the plurality of beam structures 200, 300, 400, and 500, may provide a safe path for the plurality of cables 1020 and 1030. Specifically, the enclosed channels of the plurality of beam structures 200, 300, 400, and 500 may protect the plurality of cables 1020 and 1030 from adverse environmental conditions, which may damage the plurality of cables 1020 and 1030. For example, the plurality of cables 1020 and 1030, routed through the enclosed channels of the plurality of beam structures 200, 300, 400, and 500, may be protected from exposure to air and moisture which may damage the plurality of cables 1020 and 1030. Therefore, the longevity of the plurality of cables 1020 and 1030 may be extended.

Alternatively, a plurality of beam structures, such as the beam structure 100, may be coupled with an existing frame of a trailer. Specifically, the plurality of beam structures may be welded or bolted to the existing frame of the trailer. This may facilitate in routing the cables along the trailer. Thus, the cables may be protected from exposure to the outer environment, such as air or moisture, which may damage the cables.

Based on the forgoing description, a beam structure in accordance with the present invention, such as beam structures 100, 200, 300, 400, and 500, may be used for construction purposes, for example constructing a frame of a trailer. The beam structure may provide an enclosed channel adapted to receive cables therethrough, thereby facilitating routing of the cables. The beam structure may assist in increasing longevity of the cables by protecting the cables from the outer environment.

The foregoing descriptions of specific embodiments of the present disclosure have been presented for purposes of illustration and description. They are not intended to be exhaustive or to limit the disclosure to the precise forms disclosed, and obviously many modifications and variations are possible in light of the above teaching. The embodiments were chosen and described in order to best explain the principles of the disclosure and its practical application, and thereby enable others skilled in the art to best utilize the disclosure and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present disclosure.

What is claimed is:

1. A trailer comprising:

a first frame portion having a bend formed therealong, the first frame portion including first and second frame sections, each frame section including a first side panel;

a second side panel spaced apart from the first side panel;

an intermediate panel extending from an intermediate portion of the first side panel to an intermediate portion of the second side panel; and an end panel extending from an end portion of the first side panel to an end portion of the second side panel, wherein the end panel is spaced apart from the intermediate panel for configuring an enclosed channel bounded by the first side panel, the second side panel, the intermediate panel, and the end panel wherein the first and second frame sections are connected such that the first frame portion channel and the second frame portion channel intersect to form a combined channel extending through the first frame portion, and wherein the combined channel extends through the bend.

2. The trailer of claim 1 further comprising a second frame portion positioned spaced apart from the first frame portion, wherein at least a portion of the second frame portion extends toward the first frame portion.

3. The trailer of claim 2 wherein the a second frame portion has a bend formed therealong, and wherein the second frame portion includes first and second frame sections, each frame section including a first side panel;

a second side panel spaced apart from the first side panel;

an intermediate panel extending from an intermediate portion of the first side panel to an intermediate portion of the second side panel; and an end panel extending from an end portion of the first side panel to an end portion of the second side panel, wherein the end panel is spaced apart from the intermediate panel for configuring an enclosed channel bounded by the first side panel, the second side panel, the intermediate panel, and the end panel wherein the second frame portion first and second frame sections are connected such that the first frame section channel and the second frame section channel intersect to form a combined channel extending through the second frame portion, and wherein the combined channel extends through the bend.

4. The trailer of claim 1 wherein the intermediate panel extends perpendicularly from the intermediate portion of the first side panel to the intermediate portion of the second side panel.

5. The trailer of claim 1 wherein the end panel extends perpendicularly from the end portion of the first side panel to the end portion of the second side panel.

6. The trailer of claim 1 wherein the second side panel extends substantially parallel to the first side panel.

7. The trailer of claim 1 wherein the end panel extends substantially parallel to the intermediate panel.

8. The trailer of claim 1 further comprising at least one wire positioned within the enclosed channel.

9. The trailer of claim 8 wherein at least one wire extends through portion of the combined channel extending through the bend.

* * * * *

UNITED STATES PATENT AND TRADEMARK OFFICE

CERTIFICATE OF CORRECTION

PATENT NO. : 8,322,750 B2
APPLICATION NO. : 12/752346
DATED : December 4, 2012
INVENTOR(S) : Crow et al.

It is certified that error appears in the above-identified patent and that said Letters Patent is hereby corrected as shown below:

Col. 4, Line 8; Please insert --facilitate in-- before routing.

Signed and Sealed this
Twenty-ninth Day of January, 2013

David J. Kappos

David J. Kappos
*Director of the United States Patent and Trademark Office*